US007033175B2

(12) United States Patent
Kunimoto

(10) Patent No.: US 7,033,175 B2
(45) Date of Patent: Apr. 25, 2006

(54) OPTICAL DEVICE CONTROLLER IN THE TYPE OF IMITATIVE GUN

(75) Inventor: Keiichi Kunimoto, Tokyo (JP)

(73) Assignee: Western Arms, Tokyo (JP)

( * ) Notice: Subject to any disclaimer, the term of this patent is extended or adjusted under 35 U.S.C. 154(b) by 495 days.

(21) Appl. No.: 10/278,987

(22) Filed: Oct. 24, 2002

(65) Prior Publication Data

US 2003/0084601 A1 May 8, 2003

(30) Foreign Application Priority Data

Nov. 6, 2001 (JP) ..... 2001-340252

(51) Int. Cl.
*F41A 33/00* (2006.01)

(52) U.S. Cl. ..... 434/18; 434/21

(58) Field of Classification Search ..... 434/11–27
See application file for complete search history.

(56) References Cited

U.S. PATENT DOCUMENTS 5,344,320 A * 9/1994 Inbar et al. ..... 434/22
5,569,085 A 10/1996 Igarashi et al.
5,591,032 A * 1/1997 Powell et al. ..... 434/22
5,947,738 A 9/1999 Muehle et al.
6,146,141 A * 11/2000 Schumann ..... 434/11
6,682,350 B1 * 1/2004 Kehl et al. ..... 434/18

FOREIGN PATENT DOCUMENTS

KR 200-0063143 11/2000

* cited by examiner

*Primary Examiner*—Monica S. Carter
*Assistant Examiner*—Cameron Saadat
(74) *Attorney, Agent, or Firm*—Donald R. Studebaker; NixonPeabody, LLP

(57) ABSTRACT

An optical device controller, for controlling an optical device positioned in a barrel-like portion of an imitative gun facing the outside through a muzzle-like opening of the barrel-like portion. An operation controlling portion is provide for shifting the optical device from an inoperative condition to an operating condition in response to movement of a trigger-like portion, a movable valve provided on a gas leading passage for controlling the gas leading passage to be open in response to the movement of the trigger-like portion, and a sliding member having a pressure receiving portion formed therein positioned at the back of the barrel-like portion for receiving pressure of the gas coming through the gas passage formed in the gas passage forming portion and the gas leading passage which is controlled to be open by the movable valve and provided to be moved back along the barrel-like portion with the pressure of the gas acting on the pressure receiving portion.

6 Claims, 13 Drawing Sheets

OPTICAL DEVICE CONTROLLER IN THE TYPE OF IMITATIVE GUN

BACKGROUND OF THE INVENTION

1. Field of the Invention

The present invention generally relates to an optical device controller in the type of imitative gun, and more particularly, is directed to improvements in an optical device controller of the imitative gun type having a barrel-like portion and a trigger-like portion, in which an optical device positioned in the barrel-like portion to be operative, for example, to emit a laser light beam or to receive a light from the outside of the barrel-like portion is controlled in operation by handling the trigger-like portion.

2. Description of the Prior Art

There have been proposed game machines of various types which are used for a game with the aim of making a sham bullet or the like to hit a target. One type of these game machines is formed to be an electronic control game machine which has an optical device for emitting a laser light beam to a target or receiving the light from a light emitting target. There have been also proposed various electronic control game machines having the above mentioned optical device and one type of these machines which has been put to practical use is provided with a controller in the type of imitative gun for controlling the optical device which is positioned in or on the controller.

The electronic control game machine provided with the controller of the imitative gun type is usually constituted in such a manner that the controller of the imitative gun type is connected with a connecting member including electric signal transmitting lines and electric power supplying lines to a body of the electronic control game machine which contains an image display portion for displaying targets and so on as moving pictures and an electronic control portion. The controller in the form of the imitative gun type thus provided to the electronic control game machine is generally desired to be made to imitate a real gun in not only its color and shape but also its apparent operations.

As one of these controllers, there has been previously proposed such a type as to be made to have a barrel-like portion and a trigger-like portion and to obtain a mechanical recoil feeling similarly to a real recoil obtained by pulling a trigger of a real gun for shooting a bullet when the trigger-like portion is handled, as shown in Korean patent application published under publication number 2000-0063143. In this controller of the imitative gun type shown in the Korean patent application, a light emitting portion is provided to be controlled to emit a laser light by handling the trigger-like portion and the mechanical recoil is also obtained together with the emission of the laser light when the trigger-like portion is handled. For obtaining the mechanical recoil as mentioned above, a recoiling force generating portion including a cylinder and a piston inserted in the cylinder is provided on the rear end of the barrel-like portion, a hose is provided between the cylinder and an external pump and a solenoid valve is provided on the hose for making the hose open selectively. With such a structure, the solenoid valve is operative to make the hose open to connect the external pump with the cylinder so that compressed gas from the external pump flows through the hose into the cylinder when the trigger-like portion is handled. The compressed gas acts on the piston in the cylinder to cause the same to strike forcibly against a rear end wall of the cylinder. As a result, the piston and cylinder constituting the recoiling force generating portion generate the recoiling force so that the mechanical recoil is obtained when the trigger-like portion is handled.

The previously proposed controller of the imitative gun type, which is provided with the recoiling force generating portion on the rear end of the barrel-like portion as described above, is not made to imitate a real gun which has a slider movable along a barrel. Apart from this, there have been various controllers of the imitative gun type, each of which is made to have a sliding member in addition to a barrel-like portion, a trigger-like portion and an optical device for emitting a laser light beam or receiving a light from the outside so as to imitate the real gun having the slider. In the case of the controller of the imitative gun type provided with the sliding member, it has been desired that the laser light beam is emitted from the optical device through an opening provided on the barrel-like potion or the light coming through the opening provided on the barrel-like potion from the outside is received by the optical device and almost simultaneously the sliding member is moved back along the barrel-like portion to bring about a recoil when the trigger-like portion is pulled. However, there has not been previously proposed any controller of the imitative gun type which is provided with the sliding member in addition to the barrel-like portion, the trigger-like portion and the optical device for emitting the laser light beam or receiving the light from the outside so as to imitate the real gun having the slider, and in which the laser light beam is emitted from the optical device or the light from the outside is received by the optical device and almost simultaneously the sliding member is moved back along the barrel-like portion to bring about the recoil when the trigger-like portion is pulled. Further, any document disclosing such a controller of the imitative gun type as mentioned above has not been found out.

OBJECTS AND SUMMARY OF THE INVENTION

Accordingly, it is an object of the present invention to provide an optical device controller in the type of imitative gun, which has a barrel-like portion, a trigger-like portion, an optical device provided in the barrel-like portion and a sliding member movable along the barrel-like portion, and which avoids the aforementioned disadvantages encountered with the prior art.

Another object of the present invention is to provide an optical device controller in the type of imitative gun, which has a barrel-like portion, a trigger-like portion, an optical device provided in the barrel-like portion and a sliding member movable along the barrel-like portion, and in which the optical device is controlled to operate so as, for example, to emit a laser light beam and almost simultaneously the sliding member is moved back along the barrel-like portion to bring about a recoil when the trigger-like portion is pulled.

A further object of the present invention is to provide an optical device controller in the type of imitative gun, which has a barrel-like portion, a trigger-like portion, an optical device provided in the barrel-like portion and a sliding member movable along the barrel-like portion, and in which the optical device is controlled to operate so as, for example, to receive a light from the outside and almost simultaneously the sliding member is moved back along the barrel-like portion to bring about a recoil when the trigger-like portion is pulled.

According to the present invention, there is provided an optical device controller in the type of imitative gun, which comprises a trigger-like portion, a barrel-like portion having a muzzle-like opening, a gas passage forming portion fixed in connection with a rear end of the barrel-like portion for providing a gas passage formed therein, a grip portion in which a gas chamber and a gas leading passage for leading a gas from the gas chamber to the gas passage formed in the gas passage forming portion are provided, an optical device positioned in the barrel-like portion to face the outside of the barrel-like portion through the muzzle-like opening, an operation controlling portion for shifting the optical device from an inoperative condition to an operating condition in response to movement of the trigger-like portion, a movable valve provided on the gas leading passage for controlling the gas leading passage to be open in response to the movement of the trigger-like portion, and a sliding member having a pressure receiving portion formed therein to be positioned at the back of the barrel-like portion for receiving pressure of the gas coming through the gas passage formed in the gas passage forming portion and the gas leading passage which is controlled to be open by the movable valve and provided to be movable along the barrel-like portion so as to be moved back from a reference position with the pressure of the gas acting on the pressure receiving portion and then to be moved forward to return to the reference position.

In one embodiment of optical device controller according to the present invention, the optical device comprises a light emitting element for emitting a laser light beam.

In another embodiment of optical device controller according to the present invention, the optical device comprises a light receiving element for receiving a light from the outside of the barrel-like portion.

In the optical device controller thus constituted in accordance with the present invention, when the trigger-like portion is handled to move for causing the optical device positioned in the barrel-like portion to operate, the operation controlling portion operates to shift the optical device from the inoperative condition to the operating condition in response to the movement of the trigger-like portion and almost simultaneously the movable valve operates to control the gas leading passage to be open in response to the movement of the trigger-like portion so that the gas from the gas chamber flows through the gas leading passage into the gas passage formed in the gas passage forming portion and the pressure of the gas passing through the gas passage and the gas leading passage acts on the pressure receiving portion in the sliding member so as to cause the sliding member to move back along the barrel-like portion from the reference position and then to move forward along the barrel-like portion to return to the reference position. In such a situation, the sliding member which moves back first and then moves forward along the barrel-like portion is operative to bring about a mechanical recoil.

Accordingly, with the optical device controller according to the present invention, which is provided with the optical device positioned in the barrel-like portion and the sliding member movable along the barrel-like portion, such operations as to shift the optical device to the operating condition for emitting the laser light beam or receiving the light from the outside, for example, and to move the sliding member back first and then forward along the barrel-like portion to bring about the mechanical recoil are carried out when the trigger-like portion is handled to move. This means that, with the optical device controller according to the present invention, an appropriate recoil can be surely obtained when the trigger-like portion is handled.

DESCRIPTION OF THE PREFERRED EMBODIMENTS

Figure 1:
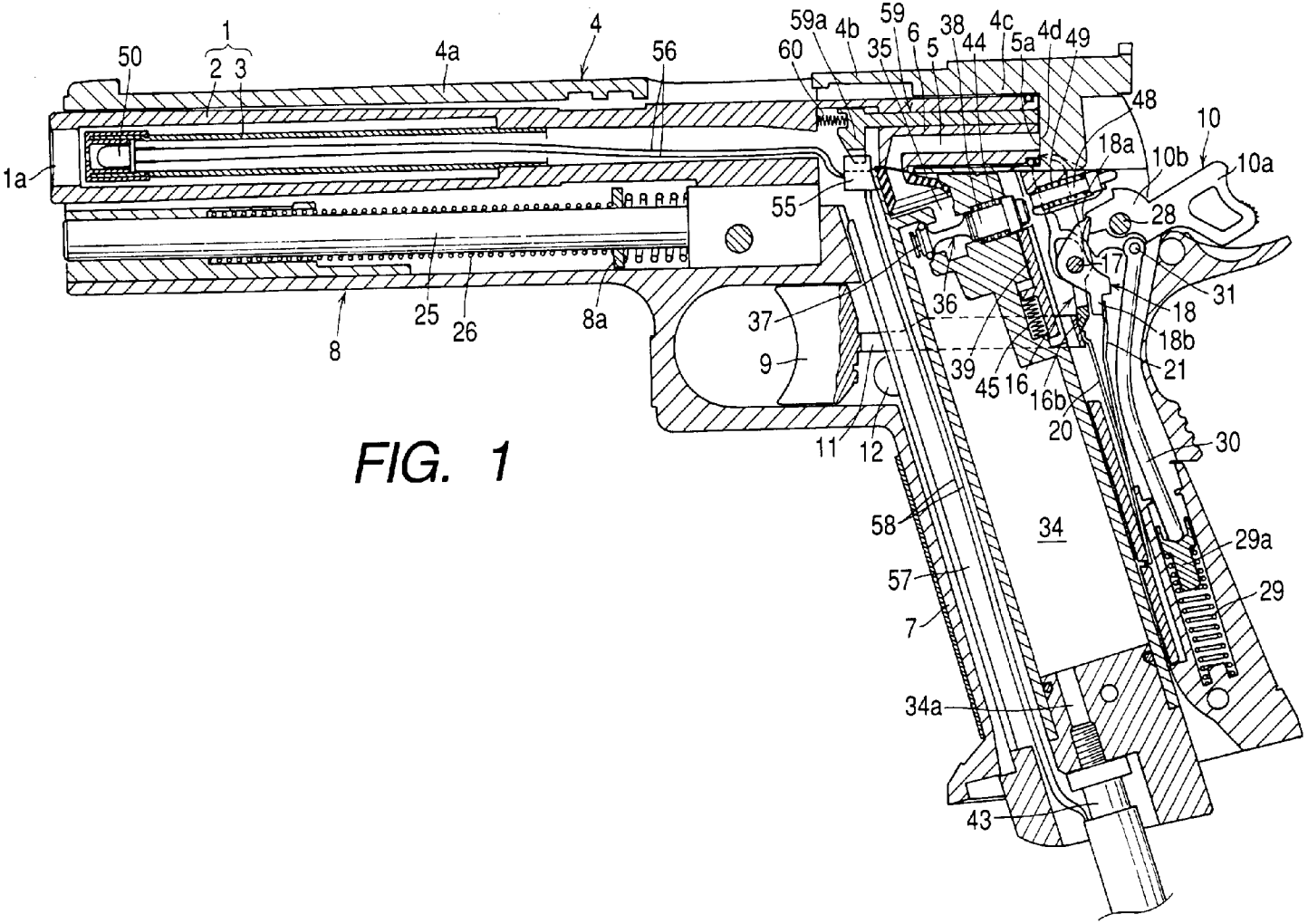
FIG. 1 is a schematic cross sectional view used for explaining the structure and operation of a first embodiment of optical device controller in the type of imitative gun according to the present invention.

FIG. 1 shows a first embodiment of optical device controller in the type of imitative gun according to the present invention.

Referring to FIG. 1, the first embodiment has a frame member 8 to which a barrel-like portion 1, a sliding member 4 movable along the barrel-like portion 1, a gas passage forming portion 6 for providing a gas passage 5 therein and a grip portion 7 are provided. A trigger-like portion 9 movable in the direction extending along the barrel-like portion 1 and a hammer-like portion 10 having an upper part 10*a* and lower part 10*b* are attached to the frame member 8.

The barrel-like portion 1 is constituted with an outer barrel-like portion 2 and an inner barrel-like portion 3. The gas passage forming portion 6 is fixed in connection with a rear end of the barrel-like portion 1 and an opening 5*a* of the gas passage 5 is formed on a rear end side surface of the gas passage forming portion 6.

A movable bar 11 extends rearward from the trigger-like portion 9 and a curved end portion of a plate spring 20 is in contact with a rear end of the movable bar 11. The plate spring 20 is operative to exert an elastic force to the movable bar 11 so as to push the trigger-like portion 9 from behind.

When the trigger-like portion 9 is pulled, the trigger-like portion 9 is moved in the direction extending along the barrel-like portion 1 from a front reference position apart forward from a projection 12 provided on the frame member 8, as shown in FIG. 1, to a rear reference position in contact with the projection 12 and the movable bar 11 is also moved against the elastic force by the plate spring 20 together with the trigger-like portion 9. A movable contacting member 16 is also in contact with the rear end of the movable bar 11. The movable contacting member 16 is in contact selectively with a rotary engaging member 18 attached rotatably on an axis 17 to the frame member 8.

The rotary engaging member 18 is provided with a curved portion having an upper end portion 18*a* which engages selectively with the lower part 10*b* of the hammer-like portion 10. The curved portion of the rotary engaging member 18 has also a lower projecting portion 18*b* with which an upper end portion of a plate spring 21 is in contact. The plate spring 21 is operative to exert an elastic force to the rotary engaging member 18 so as to cause the upper end portion 18*a* to come close to the lower part 10*b* of the hammer-like portion 10. When the trigger-like portion 9 is placed at the front reference position, the rotary engaging member 18 is placed at a rotative reference position with the lower projecting portion 18*b* positioned apart by a predetermined short distance from the rear end of the movable bar 11.

Figure 2:
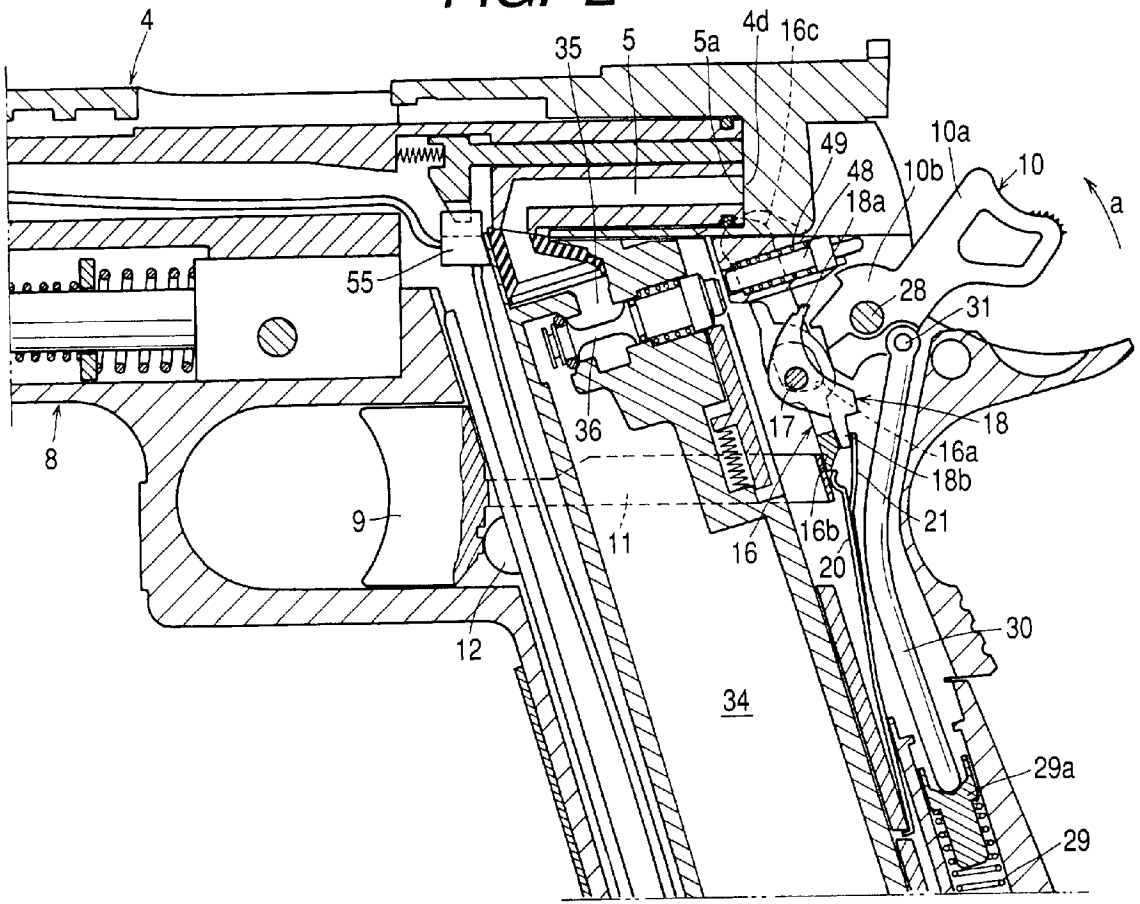
FIGS. 2 to 7 are schematic partial cross sectional views used for explaining the structure and operation of the first embodiment shown in FIG. 1.

The movable contacting member 16 has a hole 16*a* into which the axis 17 passing through the rotary engaging member 18 is inserted and a contacting portion 16*b* which comes into contact selectively with the lower projecting portion 18*b* of the rotary engaging member 18, as shown in FIG. 2. A part of the movable contacting member 16 at which the contacting portion 16*b* is provided comes into contact with both of the rear end of the trigger-like portion 9 and the curved end portion of the plate spring 20. Accordingly, the movable contacting member 16 is kept in contact with the rear end of the movable bar 11 by the elastic force exerted to the part thereof at which the contacting portion 16*b* is provided by the plate spring 20.

Further, the movable contacting member 16 has a sliding portion 16*c* extending upward from the part thereof at which the hole 16*a* is provided to a bottom of the sliding member 4. The sliding portion 16*c* is inserted to slide into a space between a pair of guides provided on the frame portion (not shown in Figs.). This movable contacting member 16 is supported by the guides with which the sliding portion 16*c* engages in such a manner that the hole 16*a* is able to move to the axis 17 which is inserted into the hole 16*a*. With such a structure, the movable contacting member 16 is able to move both upward and downward and keeps an upper position at which the contacting portion 16*b* does not push the plate spring 20 downward, as shown in FIG. 1 when the trigger-like portion 9 is placed at the front reference position. An upper end part of the sliding portion 16*c* of the movable contacting member 16 keeping the upper position is inserted into a concavity provided at the bottom of the sliding member 4 shown with a broken line in FIG. 1.

The plate springs 20 and 21 exerting the elastic force to the movable bar 11 and the movable contacting member 16, respectively, constitute a plate spring portion, together with a further plate spring positioned between the plate springs 20 and 21 to be in contact with the frame member 8 (not shown in Figs.). The plate springs 20 and 21 and the further spring positioned between the plate springs 20 and 21 are connected with one another at their lower portions.

The sliding member 4 is provided at the outside of the barrel-like portion 1 to engage movably with the frame member 8. First and second portions 4*a* and 4*b* of the sliding member 4 are constituted with a front portion of the sliding member 4 and a rear portion of the sliding member 4 incorporated with the front portion to be positioned at the back of the barrel-like portion 1, respectively. This sliding member 4 is placed at a reference position at which a front end of the first portion 4*a* comes close to a front end portion of the frame member 8 and the second portion 4*b* covers a middle portion of the frame member 8 which includes a portion of the frame member 8 between the barrel-like portion 1 and the grip portion 7, as shown in FIG. 1, when the trigger-like portion 9 is placed at the front reference position.

The first portion 4*a* of the sliding member 4 engages with a guide member 25 provided on the frame member 8 in front of the trigger-like member 9 to extend along the barrel-like portion 1 so that the sliding member 4 in its entirety is able to move along the barrel-like portion 1. A coil spring 26 is mounted on the guide member 25. The coil spring 26 thus provided extends along the guide member 25 to engage with the first portion 4*a* of the sliding member 4 and exert an elastic force to the sliding member 4 in its entirety to put the same in tendency of moving forward. A part of the first portion 4*a* of the sliding member 4 which is in engagement with the guide member 25 is placed apart by a predetermined short distance from a contacting portion 8*a* provided on the frame portion 8 to face the contacting portion 8*a* when the sliding member 4 is placed at the reference position.

The second portion 4*b* of the sliding member 4 is provided with a cup-shaped portion 4*c*. The gas passage forming portion 6 is inserted into the cup-shaped portion 4*c* so that the cup-shaped portion 4*c* is put in a condition of engagement with the gas passage forming portion 6 when the sliding member 4 is placed at the reference position. A bottom of the cup-shaped portion 4*c* constitutes a pressure receiving portion 4*d*. The opening 5*a* of the gas passage 5 formed in the gas passage forming portion 6 is closed by the pressure receiving portion 4*d* thus constituted when the sliding member 4 is placed at the reference position.

The lower part 10*b* of the hammer-like portion 10 is attached with an axis 28 to a rear end of the frame member 8 so that the hammer-like portion 10 in its entirety is supported to be rotatable on the axis 28 by the frame member 8. A plurality of step engaging portions are provided on the lower part 10*b* of the hammer-like portion 10. The upper part 10*a* of the hammer-like portion 10 comes into contact selectively with the cup-shaped portion 4*c* in the sliding member 4.

An upper end of a hammer strut 30, which has a lower end engaging with a coil spring 29 provided in a lower part of the grip portion 7 with a cap member 29*a*, is connected through a pin 31 to the lower part 10*b* of the hammer-like portion 10. The coil spring 29 is operative to exert an elastic force through the cap member 29*a* to the hammer-like portion 10 and thereby the hammer-like portion 10 is forced to rotate in a direction indicated with an arrow a shown in FIG. 2 (a direction) so as to move the upper part 10*a* toward a rear end portion of the sliding member 4. The hammer-like portion 10 is kept in a condition of standing by with the lower part 10*b* fixed in position by the engagement of the upper end portion 18*a* of the rotary engaging member 18 which is placed at the rotative reference position, as shown in FIG. 1.

In the grip portion 7, a gas chamber 34, a gas leading passage 35 extending upward from the gas chamber 34, a movable valve 36 operative to control the gas leading passage 35 to be open and closed selectively, and a locking member 39 engaging selectively with the movable valve 36 are provided. A gas supplying passage 34*a* is provided in connection with the gas chamber 34 and a hose 43 is connected with the gas supplying passage 34*a* to extend from the inside to the outside of the grip portion 7. The gas supplying passage 34*a* is operative to lead a gas supplied through the hose 43 from an external gas source into the gas chamber 34.

The gas leading passage 35 leads to the gas passage 5 formed in the gas passage forming portion 6. Under a condition wherein the opening 5*a* of the gas passage 5 is closed by the pressure receiving portion 4*d* in the sliding member 4 and the gas leading passage 35 is closed by the movable valve 36, each of the gas passage 5 and the gas leading passage 35 is sealed up.

The movable valve 36 has a valve element 37 positioned in the gas leading passage 35 and a rod 38 projecting to the outside of the gas leading passage 35 and provided to be movable in a direction along the rod 38 in the grip portion 7. A coil spring 44 is mounted on the rod 38 and the movable valve 36 is forced by the coil spring 44 to keep normally a position for controlling the gas leading passage 35 to be closed with the valve element 37.

The locking member 39 is provided at the back of the rod 38 of the movable valve 36 to be able to move up and down selectively. Further, the locking member 39 is forced by a coil spring 45 mounted thereon to be put in tendency of moving toward the bottom of the sliding member 4. An up-and-down member which is selectively pushed by the sliding member 4 is connected with the locking member 39 though it is not shown in the drawings. This up-and-down member has a slotted hole into which the axis 17 is inserted and thereby is able to move within the range limited by the movement of the slotted hole to the axis 17.

The grip portion 7 is further provided with a movable pin 48 which is operative to push selectively the rod 38 of the movable valve 36 from behind. A coil spring 49 is mounted on the movable pin 48 to exert an elastic force to the same and thereby the movable pin 48 is put in tendency of moving apart from the rod 38 of the movable valve 36. The normal position of the movable pin 48 is determined in such a manner that the upper part 10*a* of the hammer-like portion 10 strikes a rear end of the movable pin 48 when the hammer-like portion 10 is rotated in the a direction. The movable pin 48 which has been struck by the hammer-like portion 10 is pushed to move against the elastic force by the coil spring 49 and the rod 38 of the movable valve 36 is pushed by the movable pin 48 to move against the elastic force by the coil spring 44. Accordingly, the valve element 37 of the movable valve 36 is moved together with the rod 38 to make the gas leading passage 35 open. When the movable valve 36 controls the gas leading passage 35 to be open in such a manner as mentioned above, the gas from the gas chamber 34 is led through the gas leading passage 35 to one end of the gas passage 5 formed in the gas passage forming portion 6.

An optical device 50 is provided in a front end part of the inner barrel-like portion 3 constituting the barrel-like portion 1 to face the outside of the barrel-like portion 1 through a muzzle-like opening 1*a* provided on the outer barrel-like portion 2 constituting the barrel-like portion 1 together with the inner barrel-like portion 3. The optical device 50 comprises, for example, a light emitting element for emitting a laser light beam or a light receiving element for receiving a light from the outside of the embodiment. A switching portion 55 which constitutes an operation controlling portion for shifting the optical device 50 from an inoperative condition to an operating condition and from the operating condition to the inoperative condition selectively, is provided in the vicinity of a position at which the gas passage forming portion 6 is coupled with the barrel-like portion 1. The switching portion 55 is electrically connected through conductors 56 in the form of lead lines extending from the switching portion 55 through the inner barrel-like portion 3 with the optical device 50. The switching portion 55 is also electrically connected through conductors 58 in the form of lead lines extending through a passage 57 provided in the grip portion 7 from the switching portion 55 to the outside of the grip portion 7 with an external control apparatus. With such electric connections, the switching portion 55 is supplied with electric power through the conductors 58 from an external electric power source contained in the external control apparatus and the optical device 50 is also supplied with electric power through the conductors 56 and 58 from the external electric power source contained in the external control apparatus.

A movable member 59 which extends to pass through the gas passage forming portion 6 in the direction along the movement of the sliding member 4 is provided to be related to the switching portion 55 constituting the operation controlling portion for the optical device 50. The movable member 59 has a wedge-shaped portion 59*a* at the outside of the gas passage forming portion 6 and a lower end part of the wedge-shaped portion 59*a* engages with the switching portion 55. A coil spring 60 is provided between the rear end part of the barrel-like portion 1 and an upper end part of the wedge-shaped portion 59*a* of the movable member 59 and thereby the movable member 59 in its entirety is forced by the coil spring 60 toward the pressure receiving portion 4*d* in the sliding member 4. Consequently, a rear end portion of the movable member 59 comes into contact with the pressure receiving portion 4*d* in the sliding member 4 when the sliding member 4 is placed at the reference position.

The movable member 59 is pushed by the pressure receiving portion 4*d* in the sliding member 4 toward the rear end part of the barrel-like portion 1 against the elastic force by the coil spring 60 and the wedge-shaped portion 59*a* of the movable member 59 is positioned apart from a front end side surface of the gas passage forming portion 6 which faces the rear end part of the barrel-like portion 1 when the sliding member 4 is placed at the reference position. When the movable member 59 is placed at such a position, the lower end part of the wedge-shaped portion 59*a* of the movable member 59 is operative to put the switching portion 55 in an OFF state for causing the optical device 50 to be inoperative continuously.

The movable member 59 is moved back with the elastic force by the coil spring 60, together with the sliding member 4, to a position at which the wedge-shaped portion 59*a* comes into contact with the front end side surface of the gas passage forming portion 6 when the sliding member 4 moves back from the reference position. In such a situation, the lower end part of the wedge-shaped portion 59*a* of the movable member 59 is operative to put the switching portion 55 in an ON state for shifting the optical device 50 from the inoperative condition to the operating condition so as to maintain the operating condition during an extremely short period and then to put the switching portion 55 in the OFF state again for shifting the optical device 50 from the operating condition to the inoperative condition so as to maintain continuously the inoperative condition after the extremely short period has elapsed.

When the optical device 50 is put in the operating condition by the switching portion 55, it emits a laser light beam through the muzzle-like opening 1*a* provided on the outer barrel-like portion 2 to the outside of the barrel-like portion 1 or receives a light coming into the muzzle-like opening 1*a* from the outside of the barrel-like portion 1 during the extremely short period. In the case where the optical device 50 emits the laser light beam through the muzzle-like opening 1*a* to the outside of the barrel-like portion 1, the laser light beam emitted through the muzzle-like opening 1*a* to the outside of the barrel-like portion 1 is directed to, for example, a target displayed visually on an image display apparatus. On the other hand, in the case where the optical device 50 receives the light coming into the muzzle-like opening 1*a* from the outside of the barrel-like portion 1, the optical device 50 detects a light which comes into the muzzle-like opening 1*a* from a target displayed visually on an image display apparatus to produce a detection output signal in response to the detected light and transmits the detection output signal through the conductors 56, the switching portion 55 and the conductors 58 to the external control apparatus.

In the embodiment shown in FIG. 1 and constituted as mentioned above, under a condition wherein the opening 5*a* of the gas passage 5 formed in the gas passage forming portion 6 is closed by the pressure receiving portion 4*d* in the sliding member 4 which is placed at the reference position, the movable valve 36 controls the gas leading passage 35 to be closed with the elastic force by the coil spring 44, the locking member 39 is pushed down against the elastic force by the coil spring 45 by the rod 38 of the movable valve 36 making the gas leading passage 35 closed so as to be placed at a lower position, the movable pin 48 is positioned apart by the predetermined short distance from the rear end portion of the rod 38 of the movable valve 36 making the gas leading passage 35 closed, the rotary engaging member 18 is placed at the rotative reference position with the lower projecting portion 18*b* positioned apart by the predetermined short distance from the contacting portion 16*b* of the movable contacting member 16 placed at the upper position, and the hammer-like portion 10 is kept in the condition of standing by with the lower part 10*b* fixed in position by the engagement of the upper end portion 18*a* of the rotary engaging member 18 which is placed at the rotative reference position, when the trigger-like portion 9 is pulled to move from the front reference position to the rear reference position, the movable bar 11 is moved back against the elastic force by the plate spring 20 with the movement of the trigger-like portion 9 to push the movable contacting member 16.

The movable contacting member 16 pushed by the movable bar 11 moving back is operative to rotate the rotary engaging member 18 against the elastic force by the plate spring 21 with the contacting portion 16*b* thereof engaging with the lower projecting portion 18*b* of the rotary engaging member 18 so as to release the upper end portion 18*a* of the rotary engaging member 18 from the engagement with the lower part 10*b* of the hammer-like portion 10. As a result, the hammer-like portion 10 is disengaged from the rotary engaging member 18 to be rotated in the a direction with the elastic force by the coil spring 29.

Figure 3:
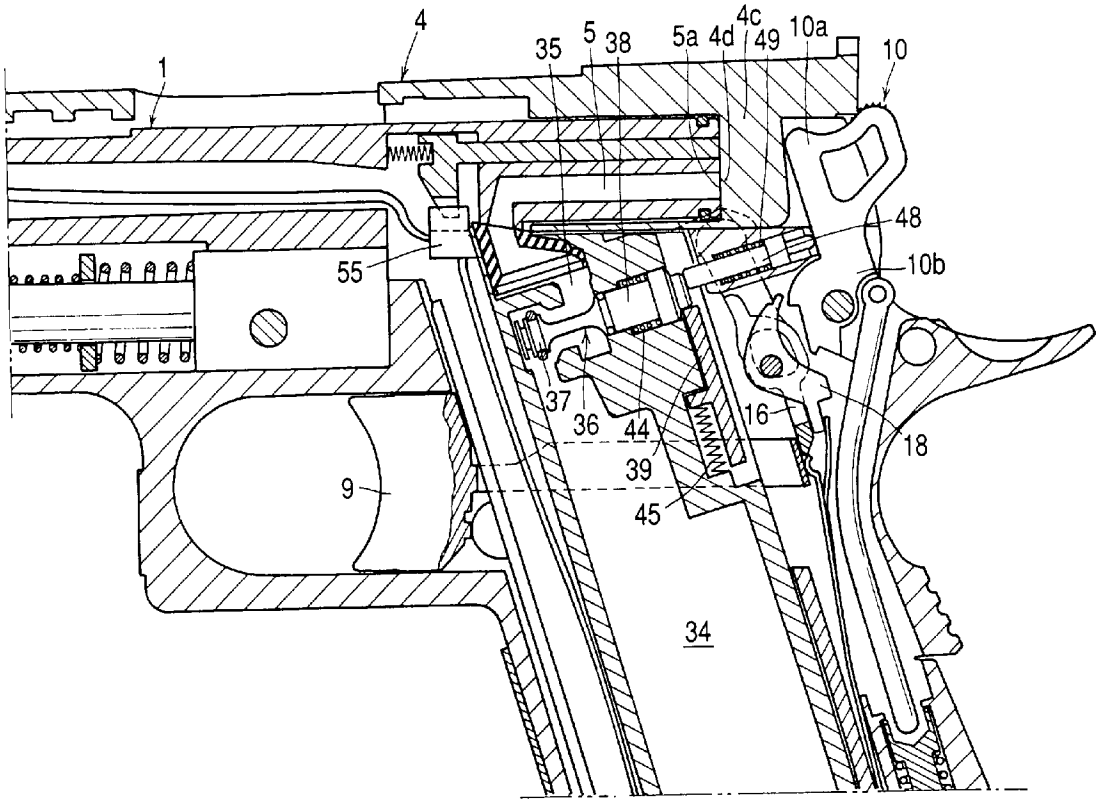

The upper part 10*a* of the hammer-like portion 10 rotating in the a direction strikes the movable pin 48 to move the same against the elastic force by the coil spring 49, as shown in FIG. 3. The upper part 10*a* of the hammer-like portion 10 which has struck the movable pin 48 bumps against the cup-shaped portion 4*c* of the sliding member 4 to stop the hammer-like portion 10 from rotating in the a direction.

The movable pin 48 moving against the elastic force by the coil spring 49 strikes the rod 38 to move the movable valve 36 having the rod 38 against the elastic force by the coil spring 44 so that the valve element 37 of the movable valve 36 controls the gas leading passage 35 to be open. Namely, the hammer-like portion 10 constitutes a rotary member which rotates to exert the striking force to the movable valve 36 through the movable pin 48 so as to shift the movable valve 36 from a condition for controlling the gas leading passage 35 to be closed to another condition for controlling the gas leading passage 35 to be open with the movement of the trigger-like portion 9 caused by pulling the same.

Figure 4:
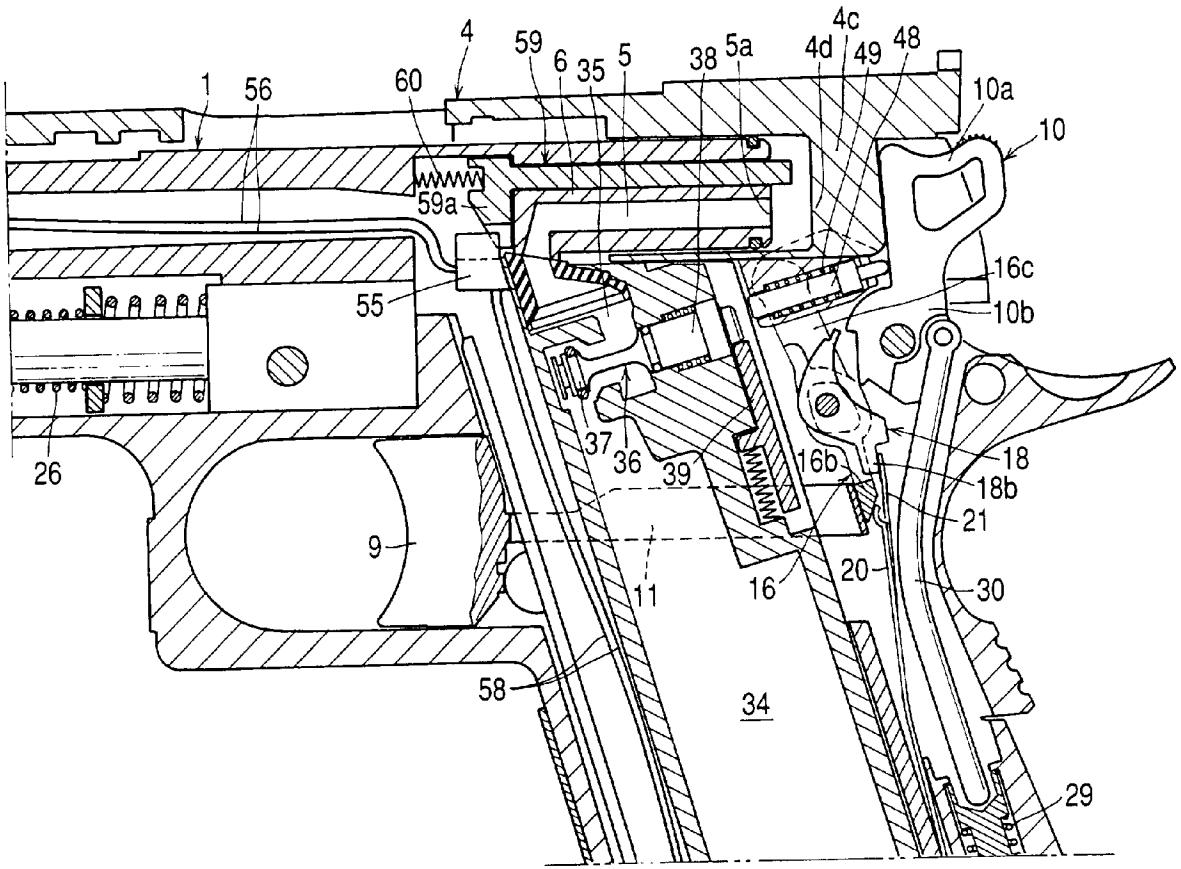

With the movement of the movable valve 36 against the elastic force of the coil spring 44, the locking member 39 placed at the lower position is released from being pushed down by the rod 38 of the movable valve 36 to be pushed up with the elastic force by the coil spring 45. The locking member 39 pushed up with the elastic force by the coil spring 45 is placed at the upper position to engage with the rear end portion of the rod 38, as shown in FIG. 4, so that the movable valve 36 is caused to maintain the condition for controlling the gas leading passage 35 open. With the movement of the locking member 39 from the lower position to the upper position, the up-and-down member connected with the locking member 39 is also moved from its lower position to its upper position.

When the gas leading passage 35 is controlled to be open by the movable valve 36, the gas from the gas chamber 34 rushes through the gas leading passage 35 into the gas passage 5 formed in the gas passage forming portion 6 with the gas so rushing into the gas passage 5, a relatively high gas pressure acts on the pressure receiving portion 4*d* in the sliding member 4 which is placed to make the opening 5*a* of the gas passage 5 closed and the sliding member 4 provided therein with the pressure receiving portion 4*d* is rapidly moved back against the elastic force by the coil spring 26 along the barrel-like portion 1 from the reference position with the gas pressure acting on the pressure receiving portion 4*d*.

When the backward movement of the sliding member 4 from the reference position is started, the movable member 59 is also moved back with the elastic force by the coil spring 60 together with the sliding member 4. The backward movement of the movable member 59 is ceased by the wedge-shaped portion 59*a* of the movable member 59 coming into contact with the front end side surface of the gas passage forming portion 6 and then only the sliding member 4 continues to move back after the movable member 59 stops, as shown in the drawings. 4.

The lower end part of the wedge-shaped portion 59*a* of the movable member 59 which is moved back together with the sliding member 4 is operative to put the switching portion 55 in the ON state for shifting the optical device 50 from the inoperative condition to the operating condition so as to maintain the operating condition during the extremely short period and then to put the switching portion 55 in the OFF state again for shifting the optical device 50 from the operating condition to the inoperative condition so as to maintain continuously the inoperative condition after the extremely short period has elapsed.

The optical device 50 put in the operating condition by the switching portion 55 emits the laser light beam though the muzzle-like opening 1*a* provided on the inner barrel-like portion 3 to the displayed target on the image displaying apparatus or detects the light coming into the muzzle-like opening 1*a* from the displayed target on the image displaying apparatus for producing the detection output signal in response to the detected light and transmitting the detection output signal through the conductors 56, the switching portion 55 and the conductors 58 to the external control apparatus.

As described above, when the trigger-like portion 9 is pulled to move from the front reference position to the rear reference position, the hammer-like portion 10 is rotated with the movement of the trigger-like portion 9 to move the movable valve 36 for controlling the gas leading passage 35 to be open and thereby the gas from the gas chamber 34 rushes through the gas leading passage 35 into the gas passage 5 so that the sliding member 4 is rapidly moved back with the gas pressure acting on the pressure receiving portion 4*d* in the sliding member 4 and just after the start of the backward movement of the sliding member 4 the optical device 50 is put in the operating condition only during the extremely short period by the switching portion 55.

Since the trigger-like portion 9 is primarily provided for causing the optical device 50 to operate for emitting the laser light beam to the displayed target on the image displaying apparatus or detecting the light coming from the displayed target on the image displaying apparatus, it is understood that, when the trigger-like portion 9 is handled for causing the optical device 50 to operate, the optical device 50 is put in the operating condition and almost simultaneously the sliding member 4 is moved back from the reference position with the movement of the trigger-like portion 9.

With the backward movement of the sliding member 4 along the barrel-like portion 1, the upper end part of the sliding portion 16*c* of the movable contacting member 16 inserted into the concavity provided at the bottom of the sliding member 4 which is shown with the broken line in FIG. 2 comes out of the concavity to be pushed down by the bottom of the sliding member 4 and thereby the movable contacting member 16 is moved into the lower position with the contacting portion 16*b* thereof inserted between the rear end of the movable bar 11 and the curved end portion of the plate spring 20 to push the plate spring 20 down. With such a movement of the movable contacting member 16 to the lower position, the contacting portion 16*b* of the movable contacting member 16 is disengaged with the lower projecting portion 18*b* of the rotary engaging member 18 and thereby the rotary engaging member 18 is moved to return to the rotative reference position with the elastic force by the plate spring 21, as shown in FIG. 4.

The sliding member 4 moving back from the reference position rotates the hammer-like portion 10 in contact with the cup-shaped portion 4*c* thereof against the elastic force by the coil spring 29. With such a rotation of the hammer-like portion 10, the movable pin 48 is moved to be positioned apart by the predetermined short distance from the rear end portion of the rod 38 of the movable valve 36 with the elastic force by the coil spring 49, as shown in FIG. 4.

Figure 5:
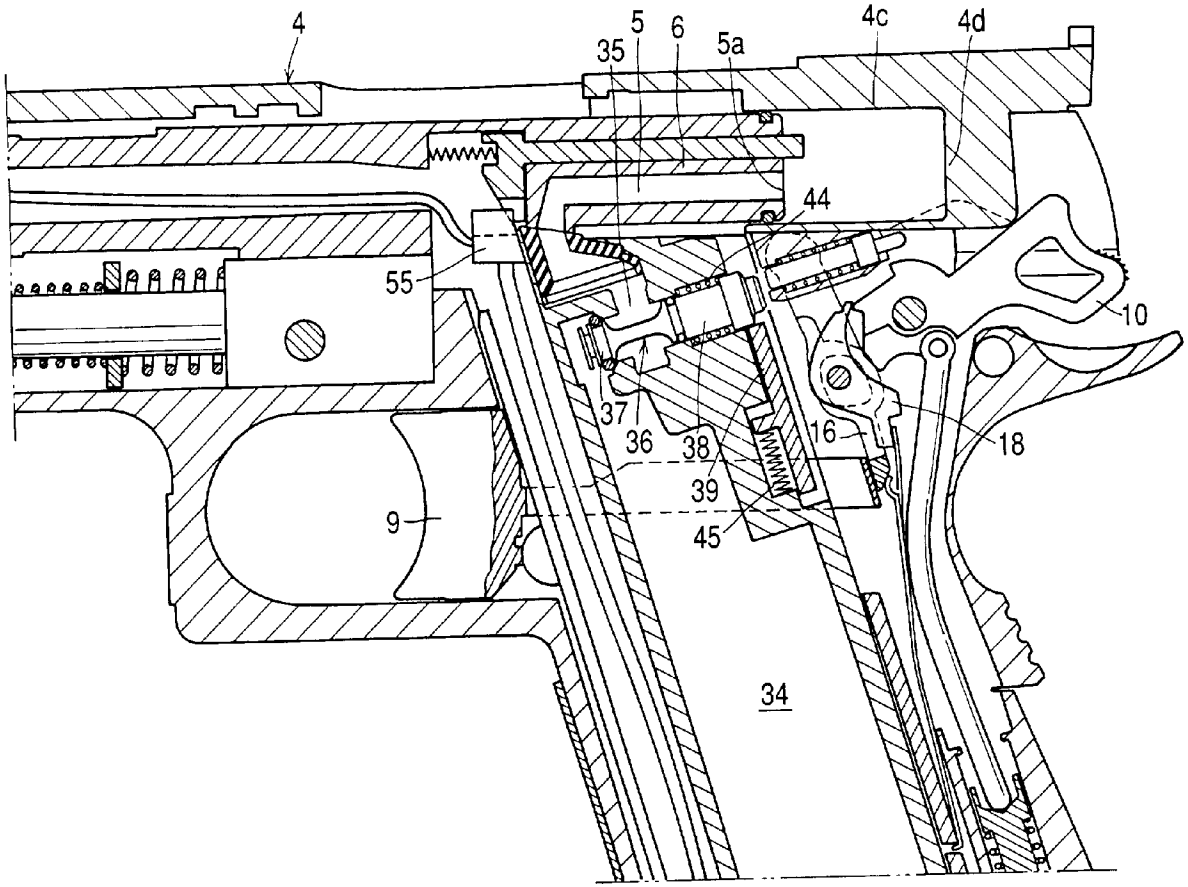
Figure 6:
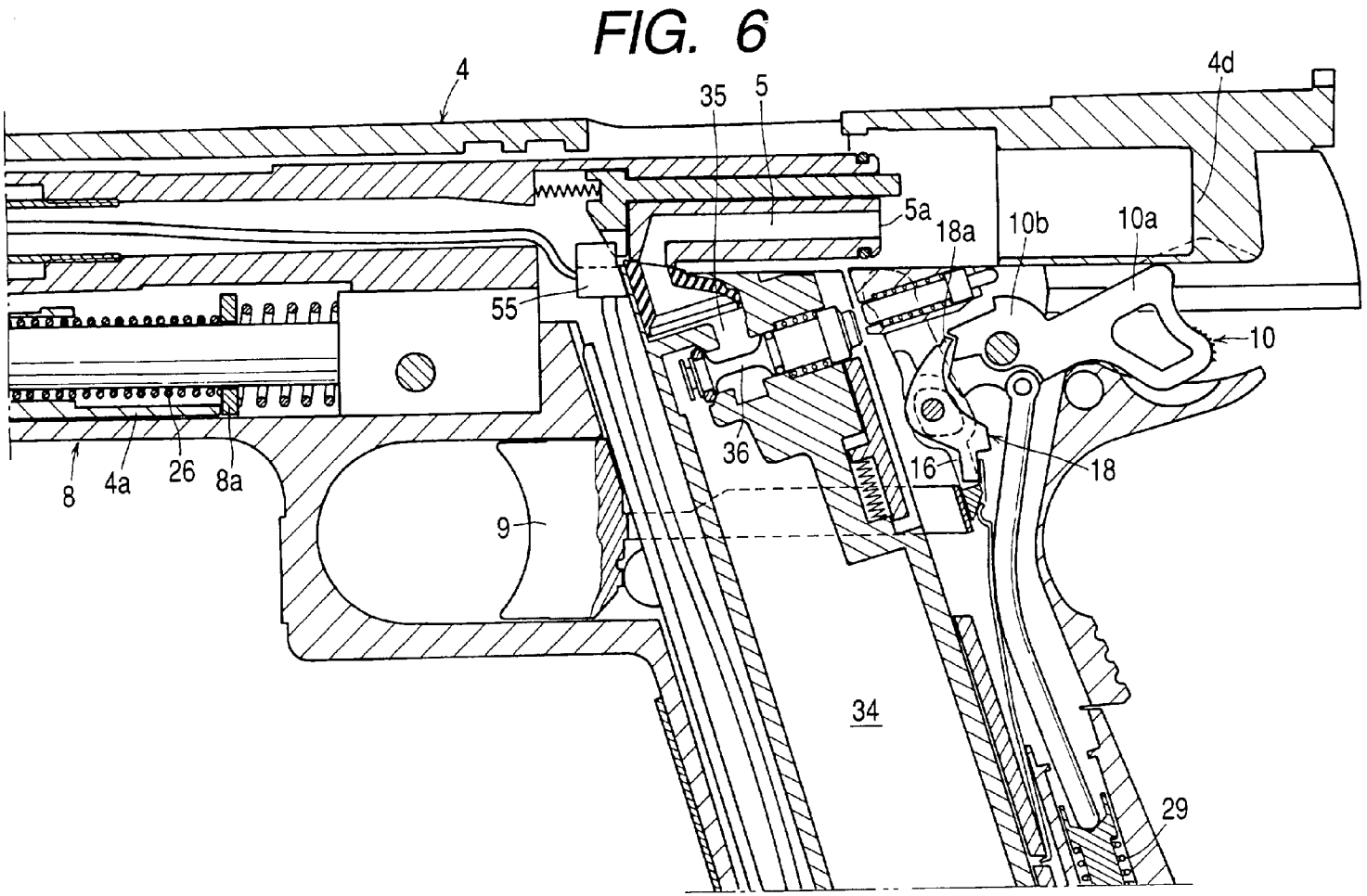

When the sliding member 4 reaches a position shown in FIG. 5 on the way of moving back, the up-and-down member connected with the locking member 39 is pushed down to move from its upper position to its lower position by the projection provided on the bottom of the sliding member 4. The locking member 39 is also pushed down to move from its upper position to its lower position against the elastic force by the coil spring 45 to be disengaged with the rod 38 of the movable valve 36. As a result, the movable valve 36 is shifted with the elastic force by the coil spring 44 from the condition for controlling the gas leading passage 35 to be open to the condition for controlling the gas leading passage 35 to be closed and thereby the gas flow from the gas chamber 34 to the gas passage 5 is stopped. The locking member 39 is pushed down by the rod 38 of the movable valve 36 which makes the gas leading passage 35 closed to be continuously placed at the lower position.

Further, with the backward movement of the sliding member 4 from the reference position, the pressure receiving portion 4*d* in the sliding member 4 is rapidly moved away from the opening 5*a* of the gas passage 5 formed in the gas passage forming portion 6. When the sliding member 4 reaches a position at which the cup-shaped portion 4*c* of the sliding member 4 is released from the engagement with the gas passage forming portion 6, the gas remains in the gas leading passage 35, the gas passage 5 and the cup-shaped portion 4*c* is discharged directly or through the opening 5*a* of the gas passage 5 to the atmosphere.

Figure 8:
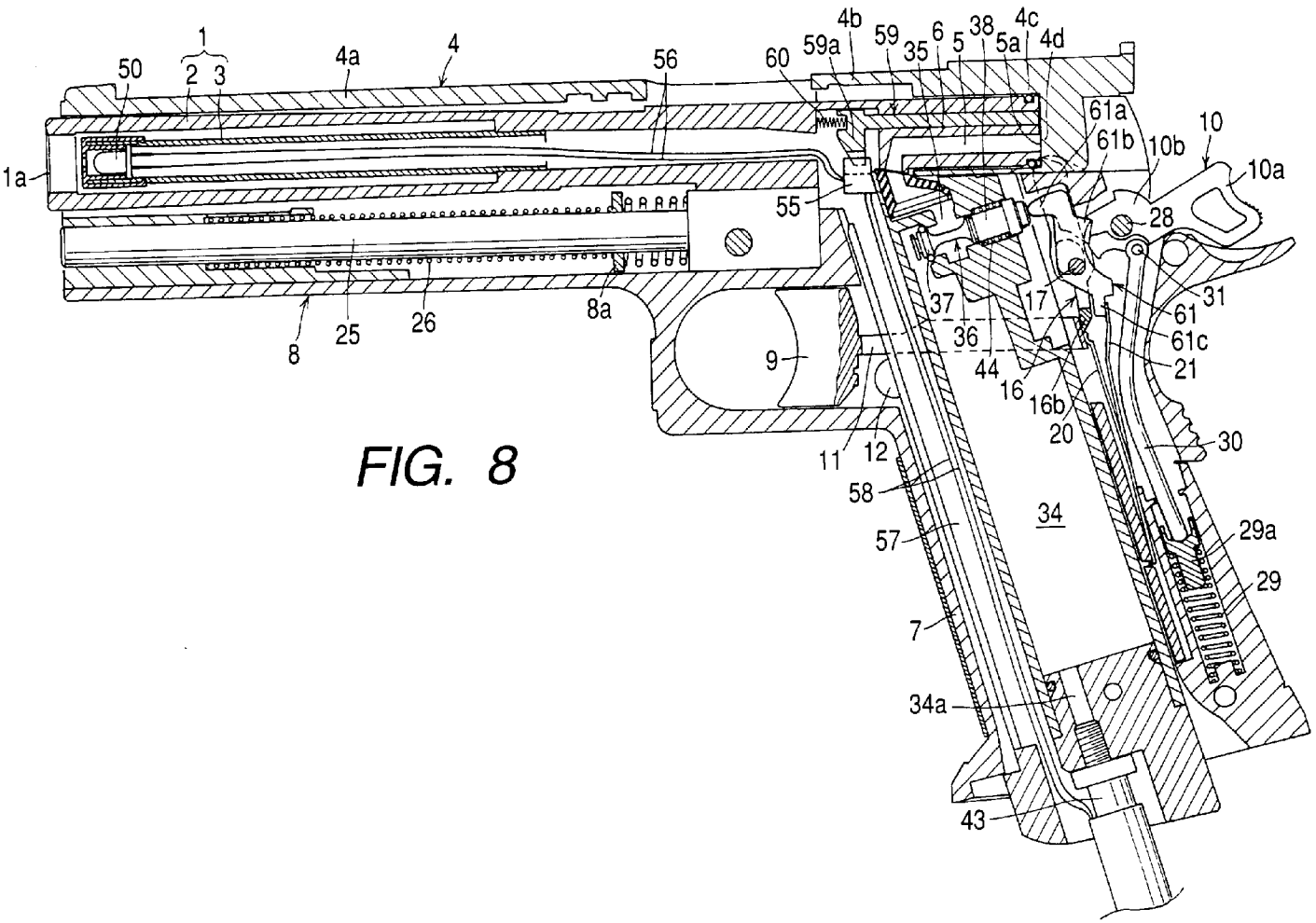
FIG. 8 is a schematic cross sectional view used for explaining the structure and operation of a second embodiment of optical device controller in the type of imitative gun according to the present invention.

After the movable valve 36 is placed at the position for controlling the gas leading passage 35 to be closed and the cup-shaped portion 4*c* of the sliding member 4 is positioned to be released from the engagement with the gas passage forming portion 6, the sliding member 4 is further moved back with the force of inertia to reach the rearmost position at which the first portion 4*a* of the sliding member 4 comes into contact with the contacting portion 8*a* provided on the frame portion 8, as shown in FIG. 8. The backward movement of the sliding member 4 from the reference position to the rearmost position as mentioned above is carried out quite rapidly and therefore the first portion 4*a* of the sliding member 4 bumps forcibly against the contacting portion 8*a* provided on the frame portion 8 to bring about a relatively heavy mechanical recoil.

Figure 7:
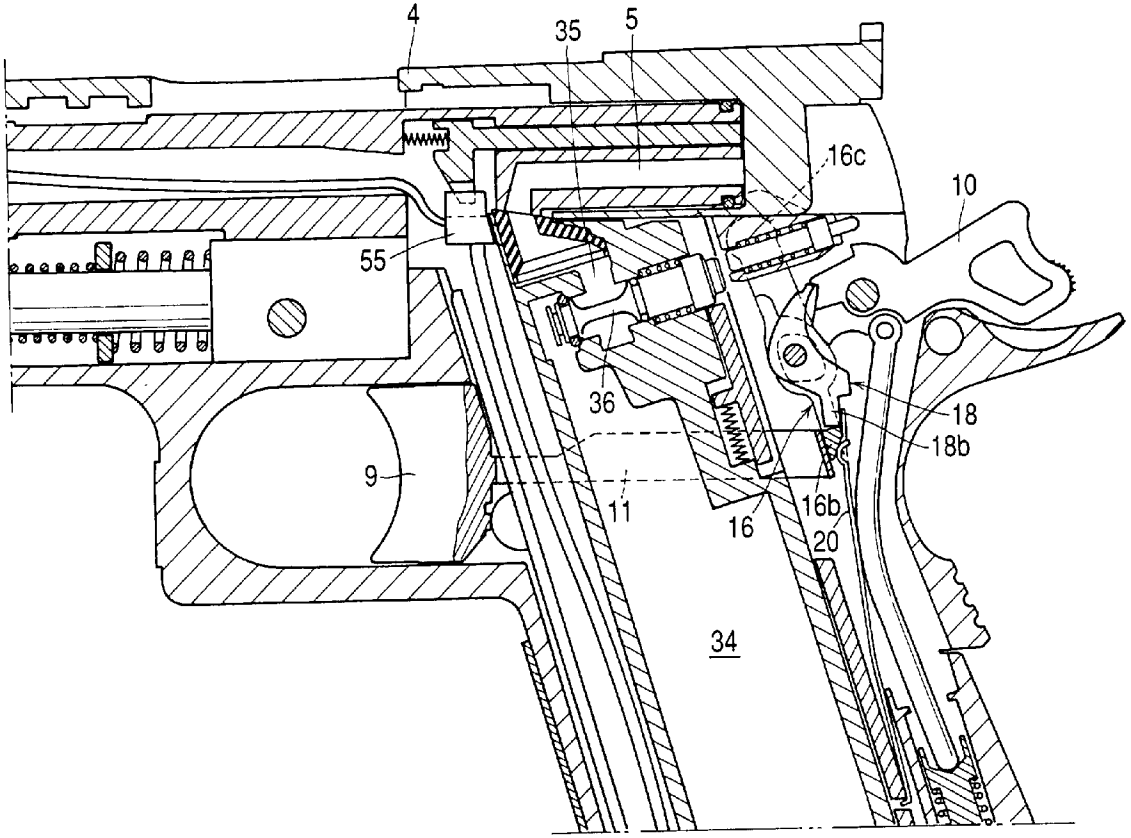

Just after the sliding member 4 has reached the rearmost position, the sliding member 4 is moved forward to return to the reference position with the elastic force by the coil spring 26. When the sliding member 4 moves to the reference position from the rearmost position, the hammer-like portion 10 is positioned with the elastic force by the coil spring 29 so as to cause the lower part 10*b* thereof to engage with the upper end portion 18*a* of the rotary engaging member 18 which is placed at the rotative reference position. As a result, the hammer-like portion 10 is fixed in position by the rotary engaging member 18 to be kept in a condition of standing by. Then, the sliding member 4 returns to the reference position, as shown in FIG. 7.

When the sliding member 4 has returned to the reference position, the sliding portion 16*c* of the movable contacting member 16 is released from being pushed down by the sliding member 4 and the movable contacting member 16 is put in a condition for being able to move to the upper position with the elastic force by the plate spring 20.

Then, when the trigger-like portion 9 is released from being pulled, the movable bar 11 is moved forward with the elastic force by the plate spring 20 to cause the trigger-like portion 9 to return to the front reference position from the rear reference position and the movable contacting member 16 is moved with the elastic force by the plate spring 20 to the upper position at which the contacting portion 16*b* is guided by a slant end part of the lower projecting portion 18*b* of the rotary engaging member 18 and the upper part of the sliding portion 16*c* is inserted again into the concavity provided at the bottom of the sliding member 4, as shown in FIG. 1.

After that, when the trigger-like portion 9 is pulled again to move from the front reference position to the rear reference position, the operation of the optical device 50 and the backward and forward movements of the sliding member 4 are carried out repeatedly in the same manner as that mentioned above.

FIG. 8 shows a second embodiment of optical device controller in the type of imitative gun according to the present invention.

In the second embodiment shown in FIG. 8, a rotary pushing member 61 is provided in place of the rotary engaging member 18, the locking member 39 and the movable pin 48 which are provided in the first embodiment shown in FIG. 1. In FIG. 8, parts and portions corresponding to those in FIG. 1 are marked with the same references and further description thereof will be omitted.

Referring to FIG. 8, the rotary pushing member 61 is attached to be rotatable on an axis 17 to a frame member 8 with an upper pushing portion 61*a* for pushing selectively a rod 38 of a movable valve 36, a projection 61*b* for engaging selectively with a lower part of a hammer-like portion 10 and a lower projecting portion 61*c* for coming into contact with an upper end portion of a plate spring 21.

The plate spring 21 is operative to exert an elastic force to the rotary pushing member 61 so as to put the upper pushing portion 61*a* of the rotary pushing member 61 in tendency of moving apart from the rod 38 of the movable valve 36 and thereby the rotary pushing member 61 is placed at a rotative reference position when a trigger-like portion 9 is placed at a front reference position. When the rotary pushing member 61 is placed at the rotative reference position, the upper pushing portion 61*a* of the rotary pushing member 61 is in contact with a rear end of the rod 38 of the movable valve 36 which is in a condition for controlling a gas leading passage 35 to be closed and the lower projecting portion 61*c* of the rotary pushing member 61 is positioned apart by a predetermined short distance from a contacting portion 16*b* of a movable contacting member 16 placed at an upper position.

In the second embodiment provided with the rotary pushing member 61 as shown in FIG. 8, under a condition wherein an opening 5*a* of a gas passage 5 formed in a gas passage forming portion 6 is closed by a pressure receiving portion 4*d* in a sliding member 4 which is placed at a reference position, the movable valve 36 controls the gas leading passage 35 to be closed with an elastic force by a coil spring 44, the rotary pushing member 61 is placed at the rotative reference position at which the upper pushing portion 61*a* is in contact with the rear end of the rod 38 of the movable valve 36 making the gas leading passage 35 closed and the lower projecting portion 61*c* is positioned apart by the predetermined short distance from the contacting portion 16*b* of the movable contacting member 16 placed at the upper position, and the hammer-like portion 10 is kept in a condition of standing by with the lower part 10*b* fixed in position by the engagement of the projection 61*b* of the rotary pushing member 61 which is placed at the rotative reference position, when the trigger-like portion 9 is pulled to move from the front reference position to a rear reference position, a movable bar 11 is moved back against an elastic force by a plate spring 20 with the movement of the trigger-like portion 9 to push the movable contacting member 16.

Figure 9:
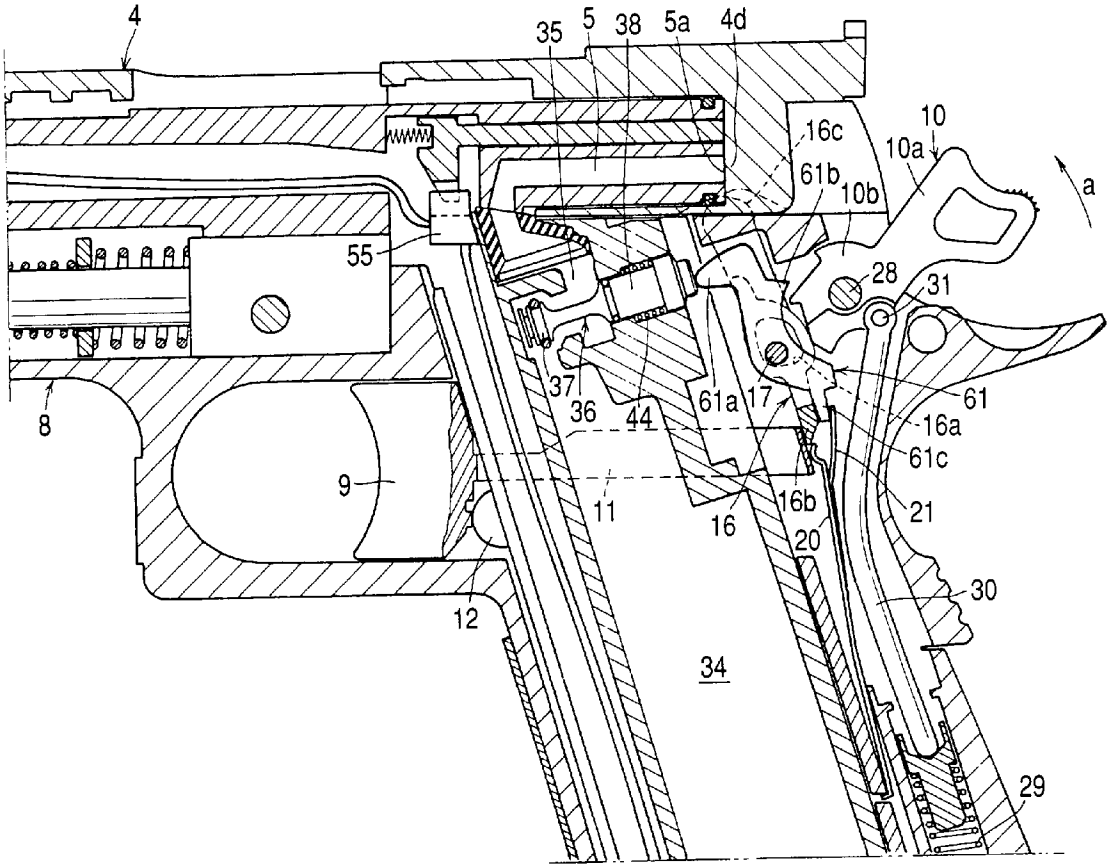
FIGS. 9 to 13 are schematic partial cross sectional views used for explaining the structure and operation of the second embodiment shown in FIG. 8.

The movable contacting member 16 pushed by the movable bar 11 moving back is operative to rotate the rotary pushing member 61 against the elastic force by the plate spring 21 with the contacting portion 16*b* thereof engaging with the lower projecting portion 61*c* of the rotary pushing member 61 so as to release the projection 61*b* of the rotary pushing member 61 from the engagement with the lower part 10*b* of the hammer-like portion 10, as shown in FIG. 9. As a result, the hammer-like portion 10 is disengaged from the rotary pushing member 61 to be rotated in a direction with an elastic force by a coil spring 29. The rotation of the hammer-like portion 10 thus carried out is stopped by the upper part 10*a* of the hammer-like portion 10 bumping against a cup-shaped portion 4*c* of the sliding member 4, as shown in FIG. 10.

Figure 10:
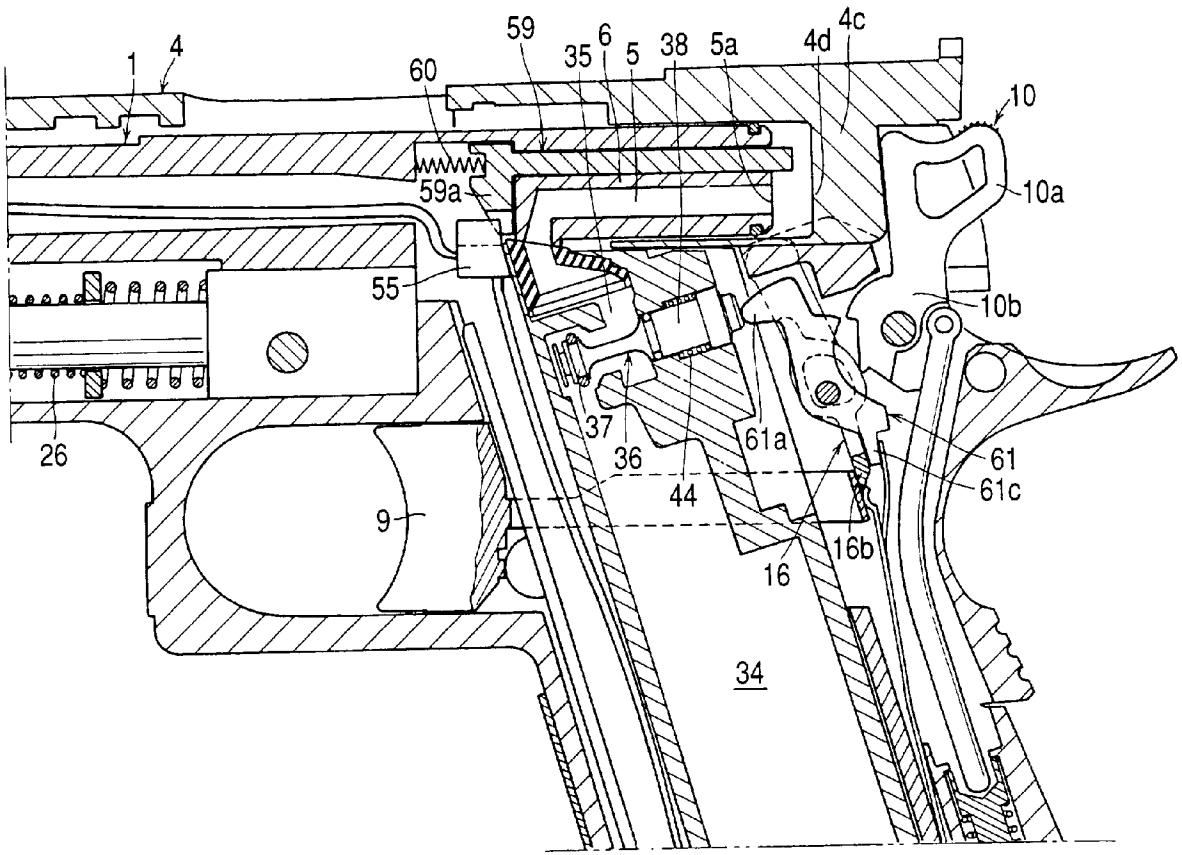

The upper pushing portion 61*a* of the rotary pushing member 61 rotating against the elastic force by the plate spring 21 pushes the rear end of the rod 38 of the movable valve 36 to move the movable valve 36 against an elastic force by a coil spring 44, as shown in FIG. 9, and thereby a valve element 37 of the movable valve 36 is moved to control the gas leading passage 35 to be open, as shown in FIG. 10. The rotary pushing member 61 pushing the rod 38 is kept in position for maintaining the movable valve 36 in a condition for controlling the gas leading passage 35 to be open by the contacting portion 16*b* of the movable contacting member 16 engaging with the lower projecting portion 61*c* of the rotary pushing member 61. Namely, the rotary pushing member 61 constitutes a rotary member which is rotated with the movement of the trigger-like portion 9 caused by pulling the same to exert the pushing force to the movable valve 36 to shift the same from the condition for controlling the gas leading passage 35 to be closed to the condition for controlling the gas leading passage 35 to be open and constitutes also a blocking member which is operative to keep the movable valve 36 in the condition for controlling the gas leading passage 35 to be open continuously.

With the movable valve 36 in the condition for controlling the gas leading passage 35 to be open continuously, a gas from a gas chamber 34 rushes through the gas leading passage 35 into the gas passage 5 formed in the gas passage forming portion 6, in the same manner as that in the embodiment shown in FIG. 1. With the gas so rushing into the gas passage 5, a relatively high gas pressure acts on the pressure receiving portion 4*d* in the sliding member 4 which is placed to make the opening 5*a* of the gas passage 5 closed and the sliding member 4 provided therein with the pressure receiving portion 4*d* is rapidly moved back against an elastic force by a coil spring 26 along a barrel-like portion 1 from the reference position with the gas pressure acting on the pressure receiving portion 4*d*, as shown in FIG. 10.

Just after the backward movement of the sliding member 4 from the reference position is started, a lower end part of a wedge-shaped portion 59*a* of a movable member 59 which is moved back together with the sliding member 4 is operative to put a switching portion 55 in the ON state for shifting the optical device 50 from an inoperative condition to an operating condition so as to maintain the operating condition during an extremely short period and then to put the switching portion 55 in the OFF state again for shifting the optical device 50 from the operating condition to the inoperative condition so as to maintain the inoperative condition continuously after the extremely short period has elapsed. The optical device 50 put in the operating condition by the switching portion 55 emits a laser light beam though a muzzle-like opening 1*a* provided on an inner barrel-like portion 3 to a displayed target on an image displaying apparatus or detects a light coming into the muzzle-like opening 1*a* from a displayed target on an image displaying apparatus during the extremely short period.

As described above, in the second embodiment shown in FIG. 8, when the trigger-like portion 9 is pulled to move from the front reference position to the rear reference position, the rotary pushing member 61 is rotated with the movement of the trigger-like portion 9 to shift the movable valve 36 from the condition for controlling the gas leading passage 35 to be closed to the condition for controlling the gas leading passage 35 to be open and thereby the gas from the gas chamber 34 rushes through the gas leading passage 35 into the gas passage 5 so that the sliding member 4 is rapidly moved back with the gas pressure acting on the pressure receiving portion 4*d* in the sliding member 4 and just after the start of the backward movement of the sliding member 4 the optical device 50 is shifted from the inoperative condition to the operating condition so as to maintain the operating condition only during the extremely short period by the switching portion 55.

In such a case also, since the trigger-like portion 9 is primarily provided for causing the optical device 50 to operate for emitting the laser light beam to the displayed target on the image displaying apparatus or detecting the light coming from the displayed target on the image displaying apparatus, it is understood that, when the trigger-like portion 9 is handled for causing the optical device 50 to operate, the optical device 50 is shifted from the inoperative condition to the operating condition and almost simultaneously the sliding member 4 is moved back from the reference position with the movement of the trigger-like portion 9.

Figure 11:
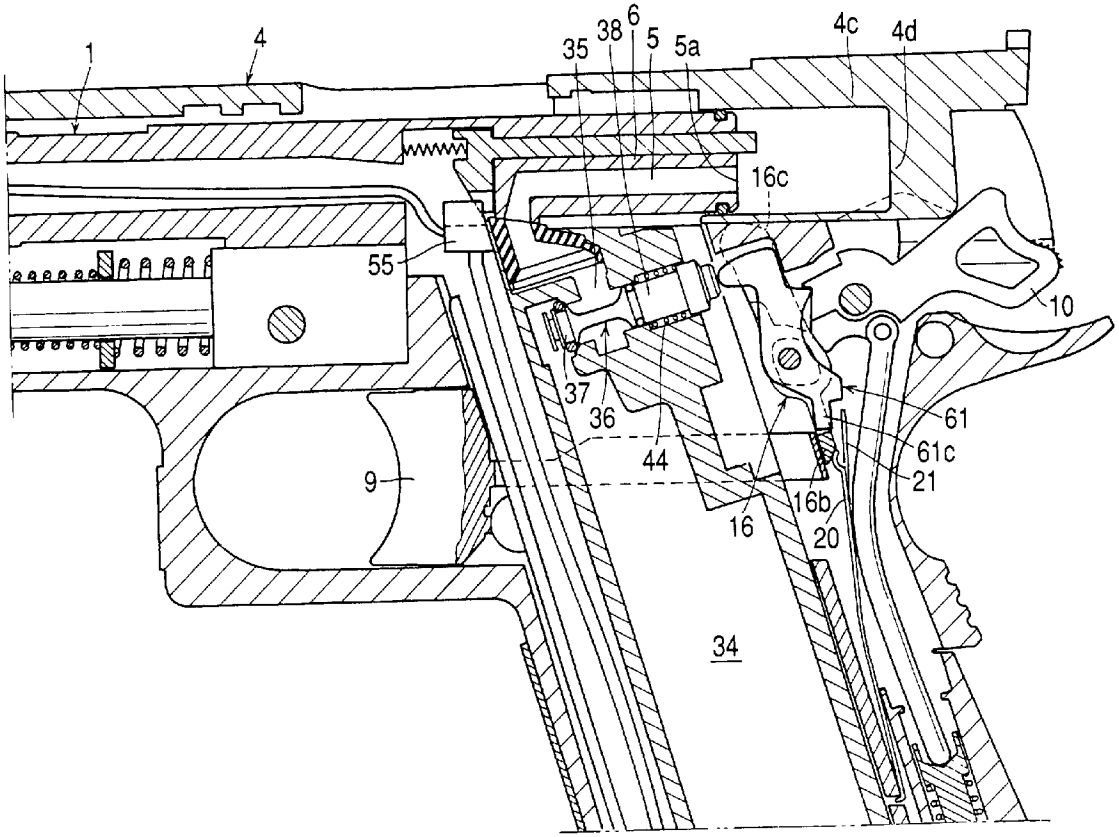
Figure 12:
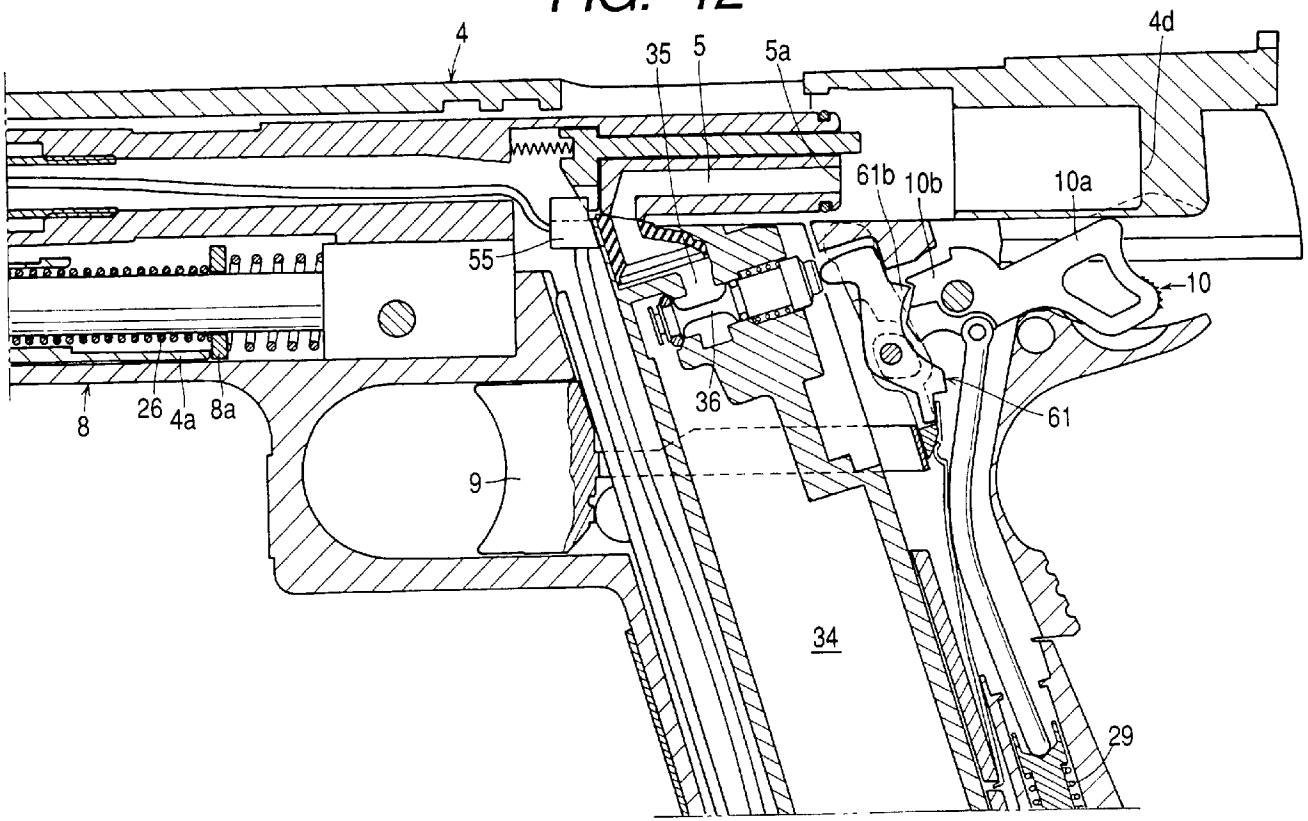

When the sliding member 4 reaches a position shown in FIG. 11 on the way of moving back, a sliding portion 16*c* of the movable contacting member 16 is pushed down by the sliding member 4 and thereby the movable contacting member 16 is moved into a lower position for pushing the plate spring 20 down. With such a movement of the movable contacting member 16 to the lower position, the contacting portion 16*b* of the movable contacting member 16 is disengaged with the lower projecting portion 61*c* of the rotary pushing member 61. As a result, the movable valve 36 is sifted with the elastic force by the coil spring 44 from the condition for controlling the gas leading passage 35 to be open to the condition for controlling the gas leading passage 35 to be closed and thereby the gas flow from the gas chamber 34 to the gas passage 5 is stopped.

Further, with the backward movement of the sliding member 4 from the reference position along a barrel-like portion 1, the pressure receiving portion 4*d* in the sliding member 4 is rapidly moved away from the opening 5*a* of the gas passage 5 formed in the gas passage forming portion 6. When the sliding member 4 reaches a position at which the cup-shaped portion 4*c* of the sliding member 4 is released from the engagement with the gas passage forming portion 6, the gas remains in the gas leading passage 35, the gas passage 5 and the cup-shaped portion 4*c* is discharged directly or through the opening 5*a* of the gas passage 5 to the atmosphere.

The movement of the movable valve 36 with the elastic force by the coil spring 44 pushes the rotary pushing member 61 with the rod 38 and the rotary pushing member 61 is moved to return to the rotative reference position by the plate spring 21 with the lower projecting portion 61*c* thereof which is apart from the plate spring 21 only for a moment, as shown in FIG. 11.

After the movable valve 36 is placed at the position for controlling the gas leading passage 35 to be closed, the sliding member 4 is further moved back with the force of inertia to reach the rearmost position at which a first portion 4*a* of the sliding member 4 bumps forcibly against a contacting portion 8*a* provided on the frame portion. As a result, a relatively heavy mechanical recoil is brought about by the first portion 4*a* of the sliding member 4 bumping forcibly against the contacting portion 8*a* when the sliding member 4 reaches the rearmost position.

Figure 13:
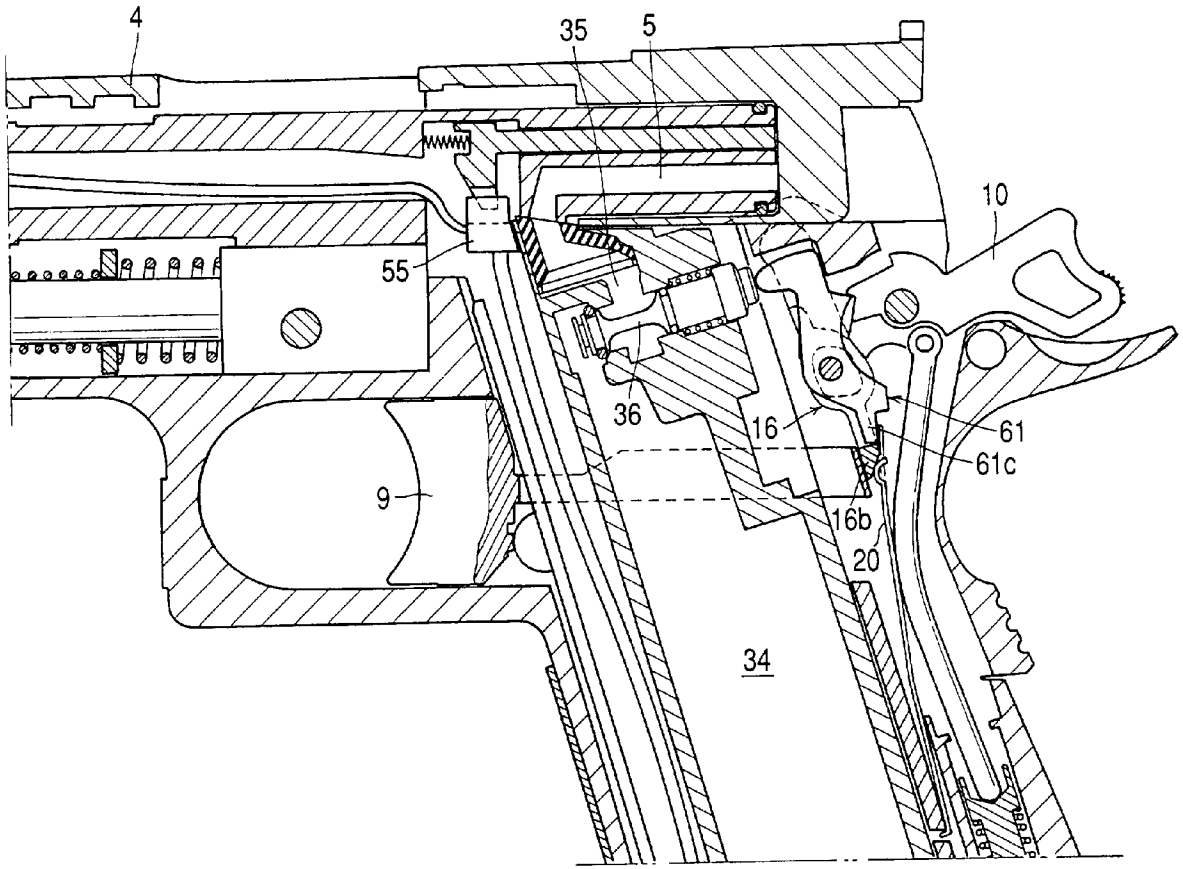

Just after the sliding member 4 has reached the rearmost position, the sliding member 4 is moved forward to return to the reference position with the elastic force by the coil spring 26. When the sliding member 4 moves to the reference position from the rearmost position, the hammer-like portion 10 is positioned with the elastic force by the coil spring 29 so as to cause the lower part 10*b* thereof to engage with the projection 61*b* of the rotary pushing member 61 which is placed at the rotative reference position. As s result, the hammer-like portion 10 is fixed in position by the rotary pushing member 61 to be kept in a condition of standing by. Then, the sliding member 4 returns to the reference position, as shown in FIG. 13.

When the sliding member 4 has returned to the reference position, the movable contacting member 16 is put in a condition for being able to move to the upper position with the elastic force by the plate spring 20. Then, when the trigger-like portion 9 is released from being pulled, the trigger-like portion 9 returns to the front reference position from the rear reference position in the same manner as that in the first embodiment shown in FIG. 1 and the movable contacting member 16 is moved with the elastic force by the plate spring 20 to the upper position at which the contacting portion 16*b* is guided by a slant end part of the lower projecting portion 61*b* of the rotary pushing member 61, as shown in FIG. 8.

After that, when the trigger-like portion 9 is pulled again to move from the front reference position to the rear reference position, the operation of the optical device 50 and the backward and forward movements of the sliding member 4 are carried out repeatedly in the same manner as that mentioned above.

Although the switching portion 55 for shifting the optical device 50 from the inoperative condition to the operating condition and from the operating condition to the inoperative condition selectively is put in the ON state and the OFF state selectively by the movable member 59 which moves back together with the sliding member 4 in each of the first and second embodiments shown in FIGS. 1 and 8, respectively, it should be understood that the optical device controller in the type of imitative gun according to the present invention is not limited to such first and second embodiments. For example, it is possible to provide a further movable member which operative directly to put the switching portion 55 in the ON state and the OFF state selectively in response to the movement of the trigger-like portion 9. In essence, it is only required that the optical device 50 is shifted from the inoperative condition to the operating condition so as to maintain the operating condition during the extremely short period when the trigger-like portion 9 is pulled.

What is claimed is:

1. An optical device controller in the type of imitative gun comprising:

a trigger-like portion, a barrel-like portion having a muzzle-like opening, a gas passage forming portion arranged at a rear end of the barrel-like portion for providing a gas passage formed therein, a grip portion including a gas chamber and a gas leading passage for leading a gas from the gas chamber to the gas passage, a movable valve provided on the gas leading passage for maintaining the gas leading passage open in response to movement of the trigger-like portion, an optical device positioned in the barrel-like portion in communication with the outside of the barrel-like portion through the muzzle-like opening, an operation controlling portion for shifting the optical device from an inoperative condition to an operating condition in response to the movement of the trigger-like portion, a sliding member having a pressure receiving portion positioned at the back of the barrel-like portion and subjected to gas pressure generated through both the gas leading pressure and the gas passage, said sliding member initially moving back along the barrel-like portion from a reference position with gas pressure acting on the pressure receiving portion and then moving forward to return to the reference position, and a movable member in operative relation with the operation controlling portion for moving together with the sliding member and enabling the operation controlling portion to shift the optical device from the inoperative condition to the operating condition whenever a backward movement relative to the reference position of the sliding member is initiated.

2. An optical device controller in the type of imitative gun according to claim 1, wherein the optical device is supplied with electric power from an external electric power source through a conductor extending from the optical device through the barrel-like portion and the grip portion to the outside of the grip portion.

3. An optical device controller in the type of imitative gun according to claim 1, wherein the optical device comprises a light emitting element for emitting a laser light beam.

4. An optical device controller in the type of imitative gun according to claim 1, wherein the optical device comprises a light receiving element for receiving a light coming from the outside of the barrel-like portion.

5. An optical device controller in the type of imitative gun according to claim 1, further comprising a rotary member operative to rotate for shifting the movable valve from a first condition for controlling the gas leading passage to be closed to a second condition for controlling the gas leading passage to be open in response to the movement of the trigger-like portion.

6. An optical device controller in the type of imitative gun according to claim 1, further comprising a gas supplying passage connected with the gas chamber for leading gas supplied from an external gas source into the gas chamber.

* * * * *